United States Patent [19]

Maehara

[11] Patent Number: 4,633,677

[45] Date of Patent: Jan. 6, 1987

[54] REFRIGERATED DISPLAY CASE

[75] Inventor: Kazuo Maehara, Isesaki, Japan

[73] Assignee: Sanden Corporation, Gunma, Japan

[21] Appl. No.: 765,216

[22] Filed: Aug. 13, 1985

[30] Foreign Application Priority Data

| | | | |
|---|---|---|---|
| Aug. 13, 1984 | [JP] | Japan | 59-122835[U] |
| Aug. 13, 1984 | [JP] | Japan | 59-122836[U] |
| Nov. 12, 1984 | [JP] | Japan | 59-186706[U] |
| Nov. 12, 1984 | [JP] | Japan | 59-186707[U] |

[51] Int. Cl.[4] ..... A47F 3/04

[52] U.S. Cl. ..... 62/256

[58] Field of Search ..... 62/255, 256

[56] References Cited

U.S. PATENT DOCUMENTS

| | | | |
|---|---|---|---|
| 3,094,851 | 6/1963 | Beckwith | 62/256 |
| 3,122,892 | 3/1964 | Beckwith | 62/256 X |
| 3,499,295 | 3/1970 | Brennan | 62/256 X |

*Primary Examiner*—Lloyd L. King

*Attorney, Agent, or Firm*—Banner, Birch, McKie & Beckett

[57] ABSTRACT

A refrigerated display case with multiple air curtain structure is disclosed. The multiple air curtains are defined by at least two air circulating conduits. An innermost conduit is partially divided into two chambers, and an evaporator is disposed in each chamber for generating the refrigerated air. A damper device extends across the discharge opening of the two chambers for selectively controlling the opening and closing of the discharge opening, whereby either one of the evaporators may be defrosted by blocking the air flow through the chamber within which it is contained, while the refrigerated air circulation continues through the other chamber to maintain the temperature in the case.

11 Claims, 17 Drawing Figures

REFRIGERATED DISPLAY CASE

TECHNICAL FIELD

This invention relates to a refrigerated display case and, more particularly, to a cooled air circulating mechanism and defroster utilized in a refrigerated display case.

BACKGROUND OF THE INVENTION

Refrigerated display cases which have a front opening portion are well known in the prior art. In the prior art, multiple air curtain construction is utilized in the display case to isolate the refrigerated space from the ambient atmosphere. In this way, the refrigerated foods or the like are easily removed from and replaced in the refrigerated display case. The display case employs an innermost air curtain and a second adjacent air curtain which are normally circulated within the display case through conduits provide therein. The innermost air curtain is normally the coldest and the second curtain is somewhat warmer. A refrigerating means, typically in the form of one or more evaporators, is located within the innermost curtain passage for cooling the air flow therethrough.

In this type of refrigerated display case, the innermost curtain passage and the refrigerating means must be frequently defrosted to remove the accumulated frost on the evaporators collected from the cooled air which impedes the operation of the equipment. On a commerical unit, such a defrosting operation is achieved by the use of electrical heaters located adjacent to the evaporator of the refrigerating means, or in some instances, by passing a hot gas through the evaporator of the refrigerating means. However, the hot gas defrost method is complex in its construction and is practical in only a small percentage of the installations. With the electrical heater defrost, the refrigerating mechanism is temporarily heated while allowing the circulating air through the air curtains. Thus, the circulating air is warmed by the high voltage electrical heater. The warm air can then melt the frost built up on the evaporator. It is important to melt this frost as rapidly as possible, in order to minimize the temperature rise of the refrigerated foods and to minimize collection of frost on the refrigerated foods from the higher humidity in the recirculated warm air.

SUMMARY OF THE INVENTION

It is a primary object of this invention to provide an improved refrigerated display case which has an effective defrosting mechanism.

It is a further object of this invention to provide a refrigerated display case in which the air circulating passage and refrigerating means are defrosted without influencing the temperature of the circulating air.

It is still a further object of this invention to provide a defrosting mechanism for a refrigerated display case which is easily adapted into current refrigerated display cases with only small modifications.

A refrigerated display case in accordance with this invention includes an interior cabinet and an exterior member, a refrigerating means, circulating means for forcing air into contact with the refrigerating means, and passage means for directing the refrigerated air. The refrigerated display case defines a front opening for access to the interior thereof, and at least two air inlets and corresponding outlets extend across the opposed edges of the front opening. The passage means includes inner and outer passages communicating with the respective outlets and inlets, the passages being defined between the interior cabinet and the exterior member. The circulating means operates to drive separate air streams through the passage means and across the access opening. The refrigerating means is located in the inner passage for refrigerating the innermost stream crossing the access opening. The inner passage of the passage means comprises a first top space which is connected with the outlet, a first bottom space which is connected with the inlet, and a first rear space upwardly extending between the first upper space and the first bottom space. The first rear space is divided into an inner and outer passage chamber, within each of which an evaporator of the refrigerating means is disposed. A damper device extends across the upper opening of the inner and outer passage chambers for selectively closing the opening of the inner or outer passage chamber. A drive device controls the operation of the damper device, whereby when the air flow through one of the passage chambers is blocked for the defrosting operation of the evaporator therein, the refrigeration air circulation continues through the other passage chamber.

Further objects, features and other aspects of this invention will be understood from the following detailed description of the preferred embodiments of this invention wtih reference to the attached drawings.

Figure 10:
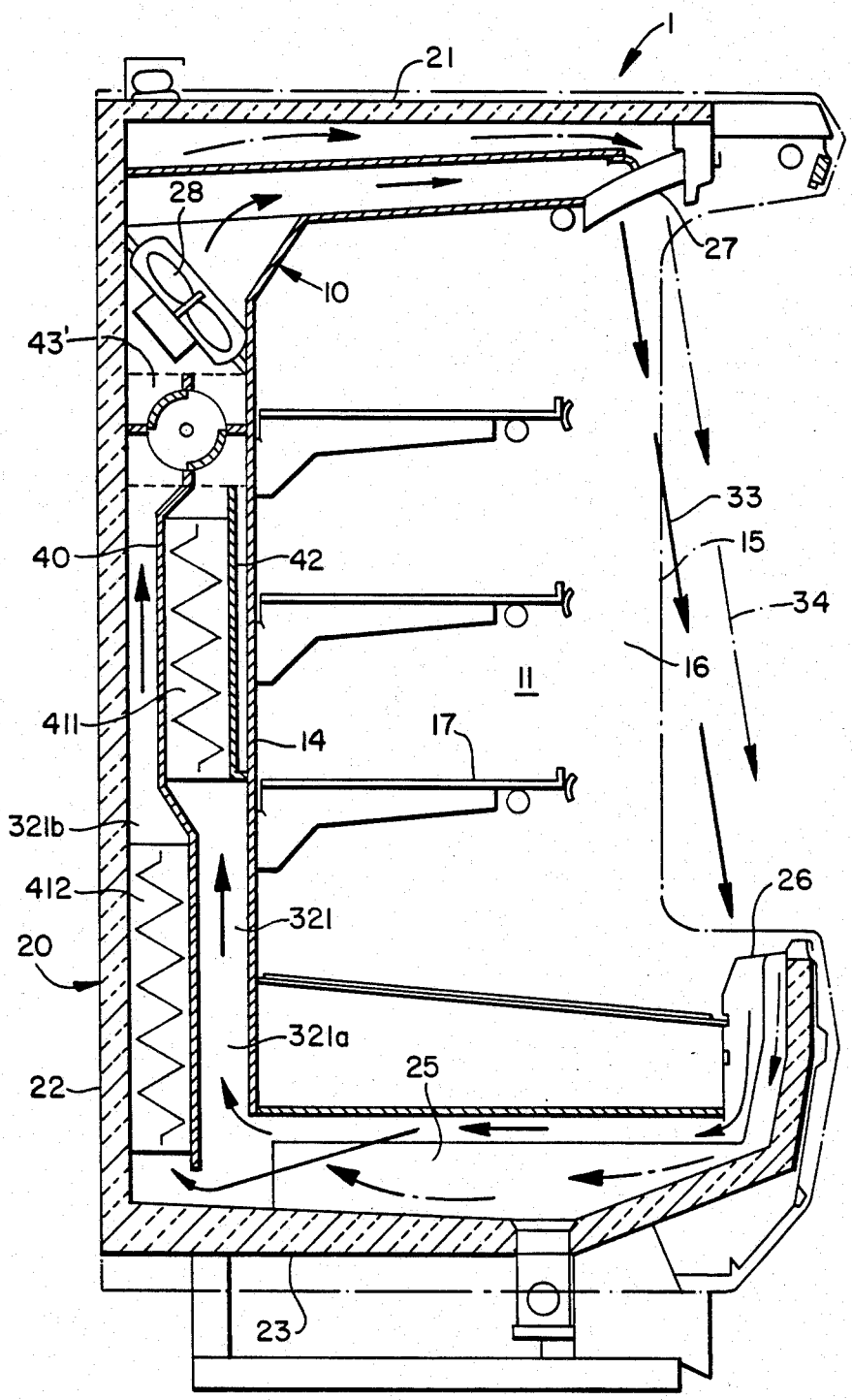
FIG. 10 is a sectional view of a refrigerated display case in accordance with still another embodiment of this invention.
Figure 11:
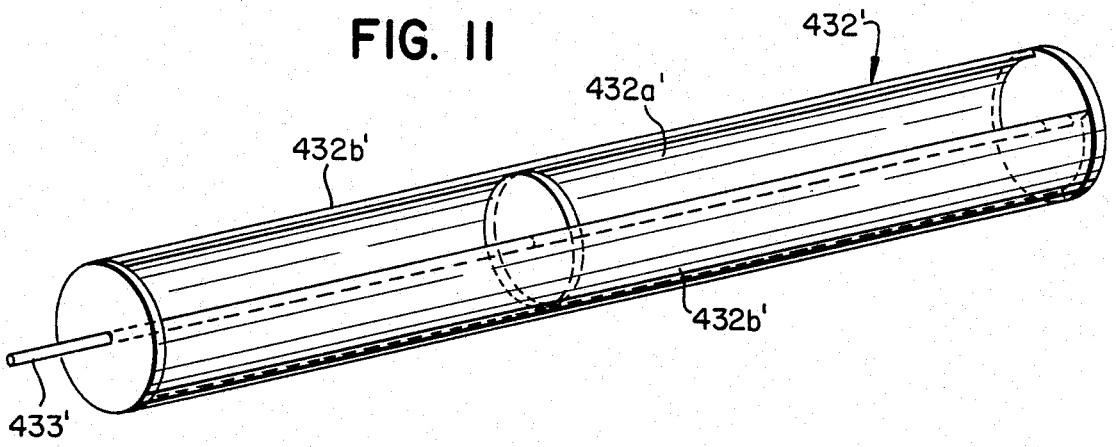
FIG. 11 is a perspective view of a cylindrical drum element utilized in the damper mechanism of FIG. 10.
Figure 12:
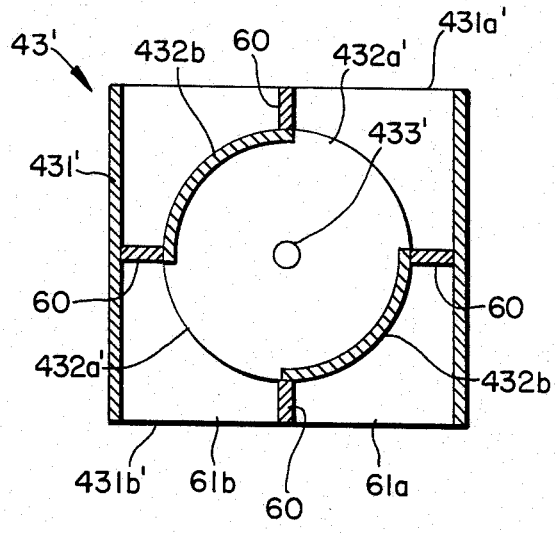
FIG. 12 is a sectional view of the damper mechanism in FIG. 10.

FIGS. **14*a*–14*d* are diagrammatic sectional views of the rear space for illustrating the operation of the damper mechanism in FIG. 10**.

DETAILED DESCRIPTION OF THE PREFERRED EMBODIMENTS

Figure 1:
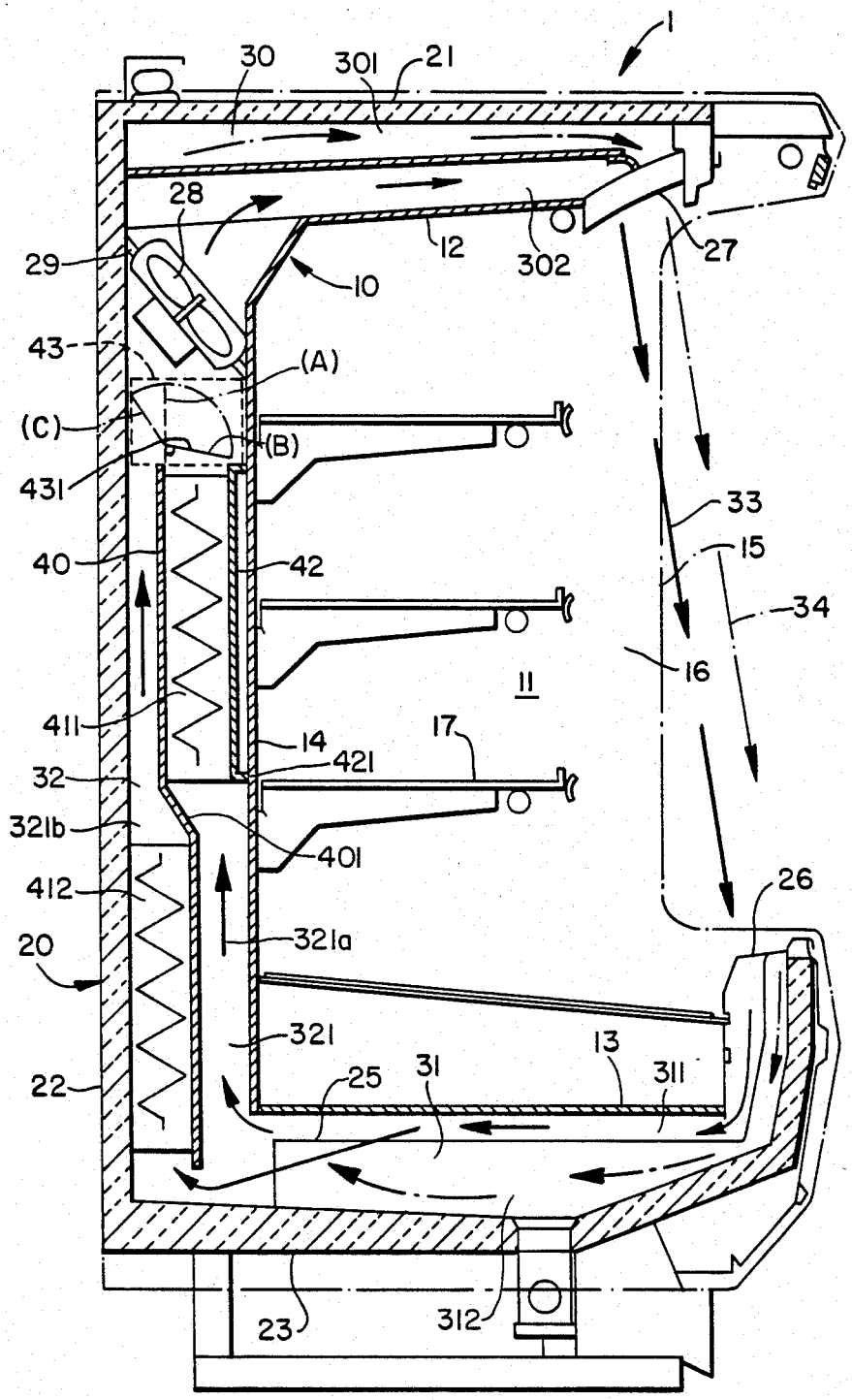
FIG. 1 is a sectional view of a refrigerated display case in accordance with one embodiment of this invention.
Figure 2:
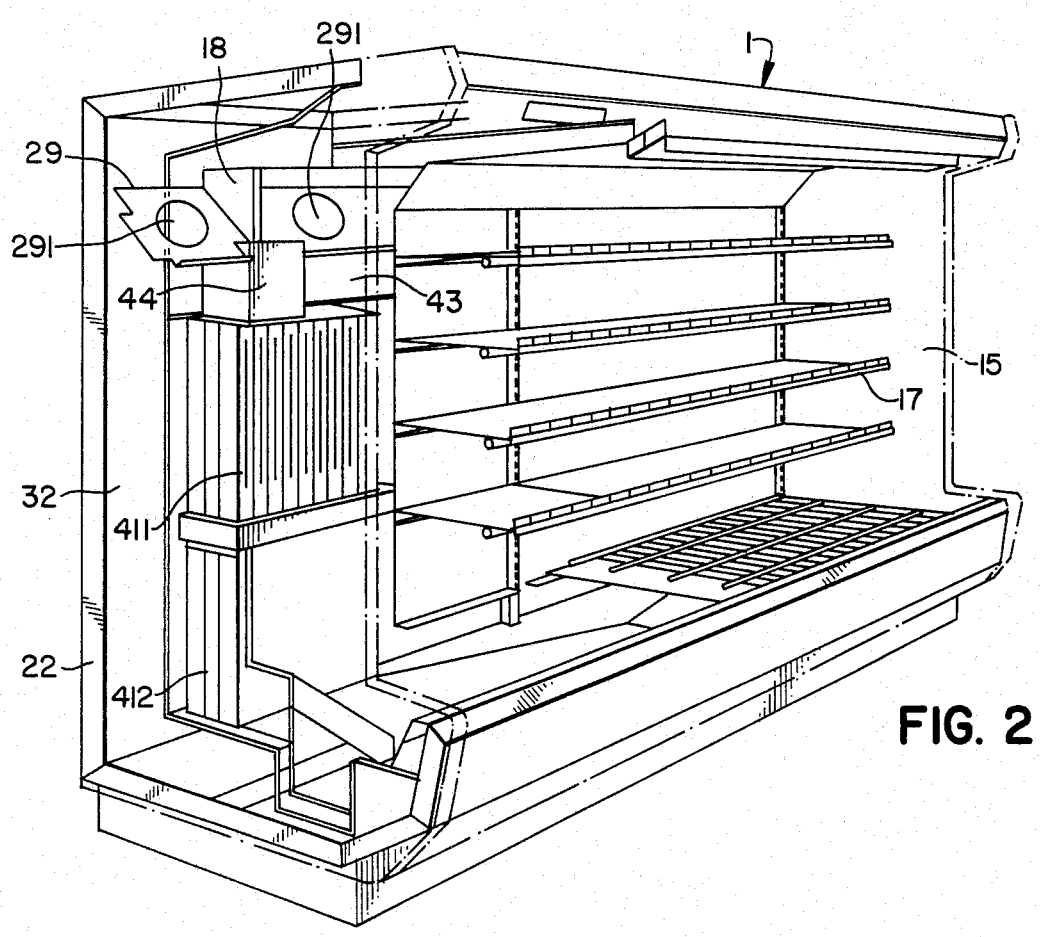
FIG. 2 is a partially exploded perspective view of the refrigerated display case in FIG. 1.
Figure 3:
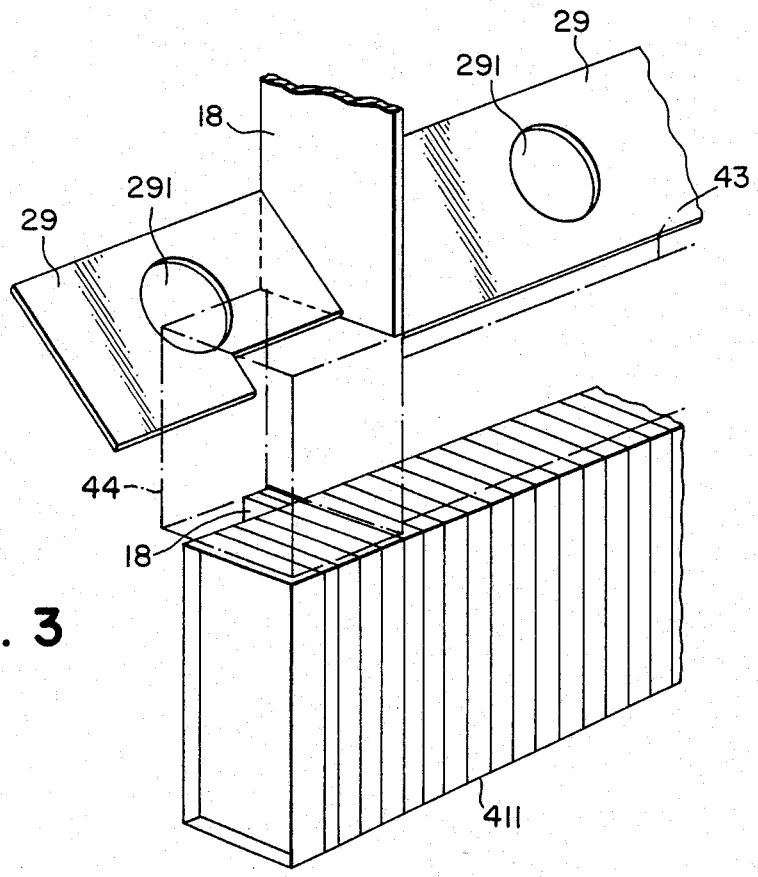
FIG. 3 is an enlarged perspective view of a refrigerated air passage used in the refrigerated display case of FIG. 1.

Referring to FIGS. 1-3, a refrigerated display case 1 in accordance with one embodiment of this invention is shown. The refrigerated display case 1 comprises an interior cabinet 10 with a display space 11 and an exterior cabinet 20. Interior cabinet 10 is defined by an upper panel 12, a bottom panel 13 and a rear panel 14 extending upwardly between the upper and bottom panels 11, 12. Display space 11 is bounded on the side by a pair of side wall panels (only one side panel 15 is indicated in FIGS. 1 and 2 by a two-dot chain line). Display space 11 has a front opening 16 at its front side to easily access the interior of display space 11 from the ambient atmosphere. Furthermore, display space 11 is divided into sections by a plurality of vertically spaced, generally horizontal shelves 17 which are mounted, preferably adjustably, on suitable uprights at rear panel 14.

The exterior cabinet 20 of case 1 is defined by a top member 21, a vertical rear wall 22 and a bottom member 23, each of which is usually formed of an insulation material. The space between the panels of interior cabinet 10 and the exterior cabinet 20 forms a plurality of air flow passages which define the multiple air curtains. In the space between the top member 21 and the upper panel 12, is disposed an upper divider panel 24 which horizontally divides the space 30, i.e., the upper space 30 is divided into two passage spaces, an upper passage space 301 and a lower passage space 302. The bottom space 31 between bottom panel 13 and bottom member 23 is also horizontally divided into two chambers or passage spaces by lower divider panel 25, i.e., an upper passage space 311 and lower passage space 312.

The space 32 formed between rear panel 14 and vertical rear wall 22 is divided by two separator plates (one of the separator plates 18 is shown in FIGS. 2 and 3) to form three passage spaces or conduits which are transversely parallel with one another. The center passage 321 of the three passages, in which a refrigerating unit is disposed, is connected with the lower passage space 302 of upper space 30 and upper passage space 311 of bottom space 31 to form a first air circulating passage. Both of the side passages of the three passages are connected with upper passage space 301 of upper space 30 and lower passage space 312 of bottom space 31 to form a second air circulating passage. Air inlets 26 are provided for each of the air circulating passages. The streams 33 and 34 which cross the front opening 16 of display space 11, pass into these inlets 26 and are driven through the passages to outlets 27 which are formed on the discharge opening of upper space 30, thus forming a clockwise circulation path as shown in FIG. 1 by the solid and dot and line arrows.

As mentioned above, the first air circulating passage is formed around display space 11, and the refrigerated air flowing through the first air circulating passage forms an enclosing air curtain across the front opening 16 of display space 11. The second air circulating passage is defined by the outer positioned passage spaces of the upper and bottom spaces and rear space 32. The inlet and outlet of the second air circulating passage are placed adjacent to and outwardly of the inlet and outlet of the first air circulating passage to form the second air stream 34. During normal operation, air is circulated through the first and second air circulating passages by a plurality of motor operated fans 28 disposed in the upper portion of rear space 32. These fans 28 cause the air circulation through the first and second air circulating passages. The temperature of the air passed through the second air circulating passage is slightly higher than the temperature of the air passed through the first air circulating passage, but below the temperature of the ambient atmosphere. Therefore, the air curtain created by the second air circulating passage protects the air temperature of the first air circulating passage from being reduced.

The center passage 321 of rear space 32, which is a component of the first air circulating passage, is vertically divided by partition plate 40 to form two chambers, inner passage chamber 321*a* and outer passage chamber 321*b*. An enlarged portion is formed on the upper portion of inner passage 321*a* and the lower portion of outer passage 321*b* by step portion 401 of partition plate 40. Evaporators 411, 412 are disposed in the enlarged portion of each passage 321*a*, 321*b*, respectively, and are disposed out of alignment with one another by the disposition of step portion 401. First evaporator 411, disposed in inner passage 321*a*, is fixed between the partition plate 40 and an attached plate 42, and second evaporator 412, disposed in outer passage 321*b*, is fixed between partition plate 40 and vertical rear wall 22. The attached plate 42 is fastened on rear panel 14 through flange 421 and extends across the side surface of first evaporator 411 to cover the side surface so as to prevent the leakage of unrefrigerated air. Damper box 43, which includes a shutter plate 431, is disposed on the upper portion of the center passage 321 to cover the discharge opening of the inner and outer passage 321*a* and 321*b* and control the opening and closing of the discharge opening. As clearly shown in FIGS. 2 and 3, fan attachment plate 29, which has a plurality of holes 291 to fasten the motor driven fan 28, is disposed above damper box 43 and extends over the upper portion of rear space 23.

Figure 4:
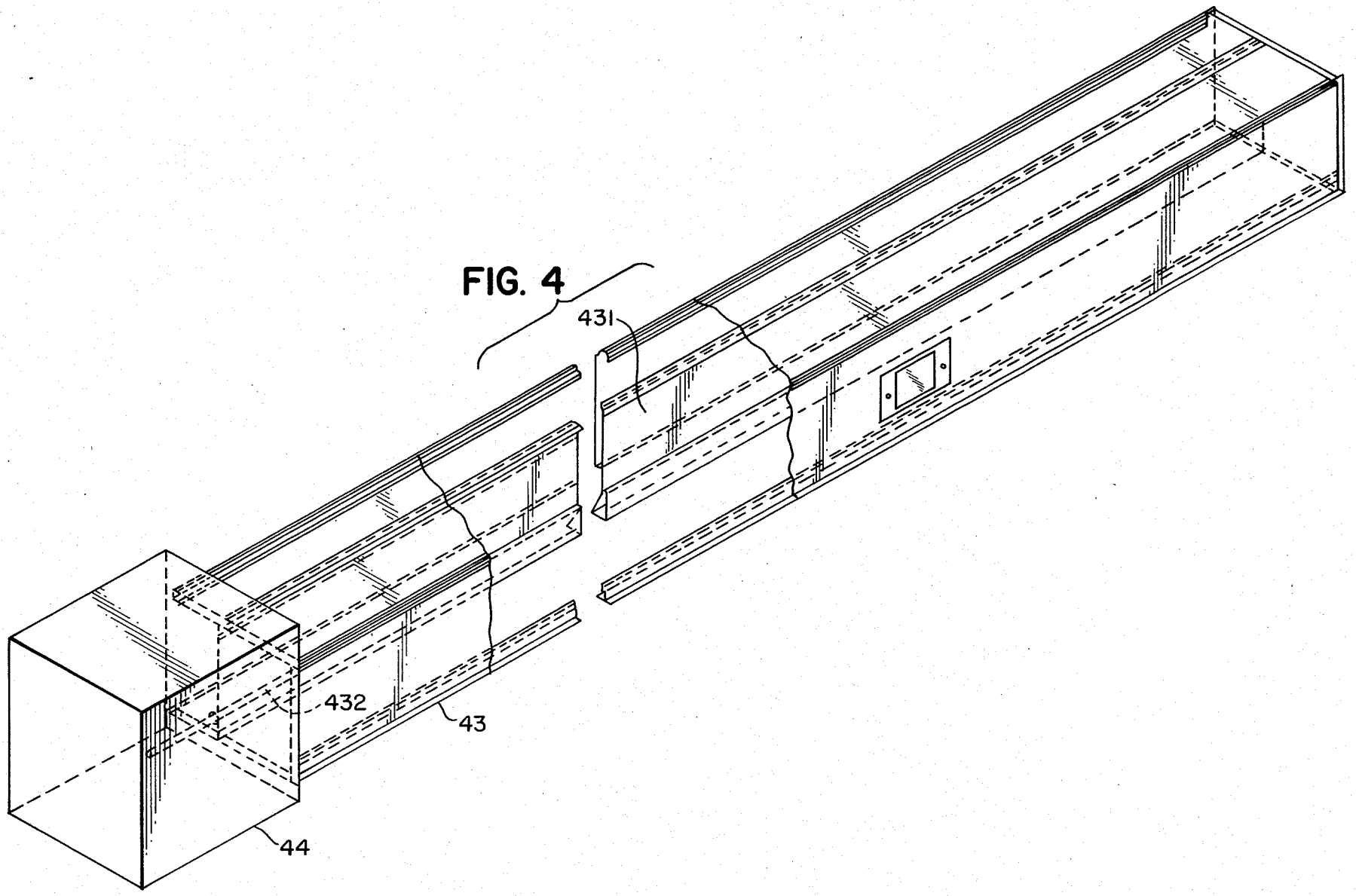
FIG. 4 is a partially exploded perspective view of a damper mechanism used in the refrigerated display case of FIG. 1.

As illustrated in FIG. 4, damper box 43 comprises a rectangular cross-sectional shaped case 433 and a shutter plate 431 rotatably supported in case 433 through support shaft 432. The upper and bottom portions of case 433 have open spaces to allow the flow of the refrigerated air. Either end portion of the damper box 43 is integrally fixed on a motor box 44 to control the rotating operation of shutter plate 431. Motor box 44 is located on the end portion of the first evaporator 411 and extends over one of the separator plates 18. To facilitate this, one of the separator plates 18 has a cut-out portion to accept the positioning of motor box 44. Thus, a major portion of motor box 44 extends into the side passage of the three passage spaces, which is a component of the second air circulating passage, which prevents any refrigerated air leakage from passing through the cut-out portion.

Figure 5:
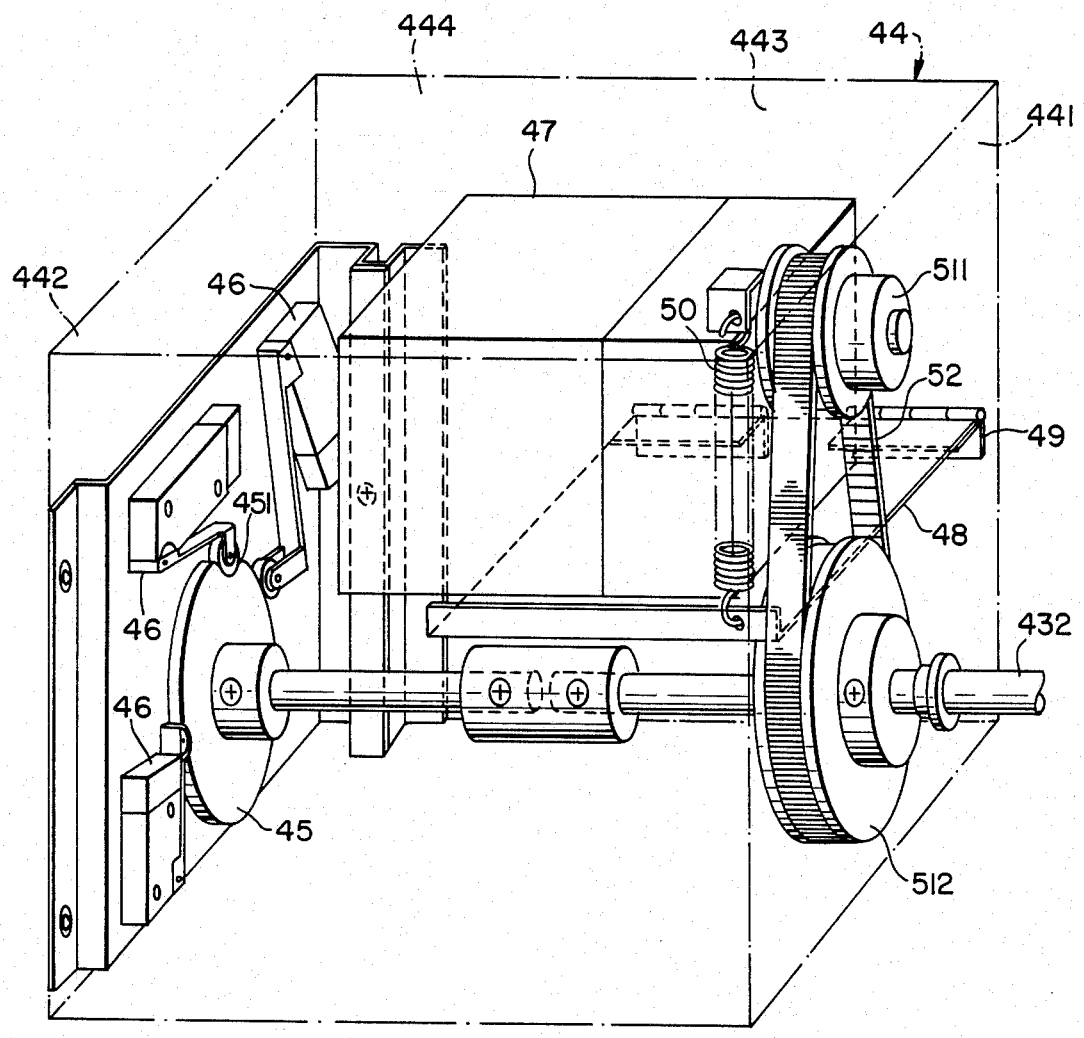
FIG. 5 is a perspective view of a damper mechanism driving device used in the refrigerated display case of this invention.
Figure 6:
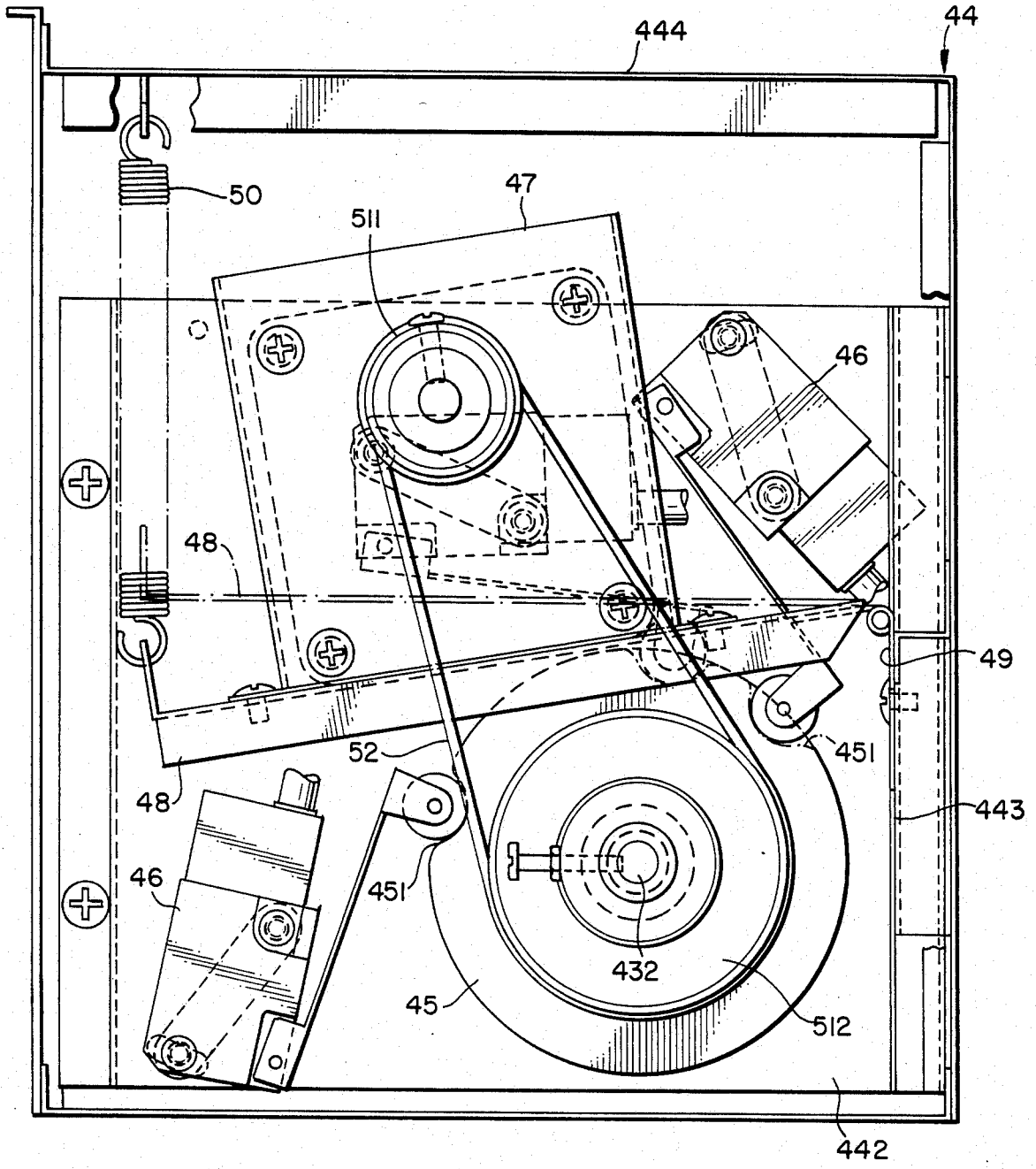
FIG. 6 is a side view of the damper mechanism driving device of FIG. 5.

With reference to FIGS. 5 and 6, one embodiment of the driving device for shutter plate 431, which is disposed within motor box 44, will be explained.

The end portion of support shaft 432 horizontally extends into motor box 44 and is rotatably supported on both side plates 441 and 442 of motor box 44. Support shaft 432 extends parallel with the longitudinal extent of damper box 43. A cam plate 45, which has a plurality of depressions 451 at its outer peripheral portion, is fixed on outer terminal end of support shaft 432, and microswitches 46 are disposed adjacent to depressions 451, to determine the rotating range of support shaft 432 and define the position of shutter plate 431. Motor 47 is placed on a motor support plate 48 of which one end portion is fastened to rear plate 443 of motor box 44 through hinge element 49 for enabling rotating motion within a limited range. The other end of motor support plate 48 is supported on upper plate 444 of motor box 44 through spring 50 which pulls the support plate 48 away from the support shaft 432; the free end portion of the motor support plate 48 being normally pulled upwardly, as shown by two dot and chain line in FIG. 6. Motor 47 is connected with support shaft 432 through a pair of teeth from pulleys 511 and 512, each of which is attached to motor 47 or support shaft 432 and belt 52, to transmit the rotating motion of motor 47 to support shaft 432.

As to the operation of the damper box and the motor box, at the initial stage of the refrigerating operation, shutter plate 431 is normally positioned in the middle of the discharge opening from damper box 43 (this position is indicated by A in FIG. 1), so that air can pass through both the inner and outer passages 321*a* and 321*b*. While the air passes through the inner and outer passages 321*a*, 321*b*, the air is cooled due to heat exchange with the first and second evaporators 411, 412. The cooled air is then circulated through the first air circulating passage due to operation of fans 28 (the flow of cooled air is indicated by solid arrow in FIG. 1).

During operation of the refrigerating unit, if the first evaporator 411 gradually develops frost which is detected by a detecting device, shutter plate 431 is moved by operation of motor 47 to cover the inner passage 321*a* (this position is indicated by B in FIG. 1). In this way, the air flow through inner passage 321*a* is intercepted by shutter plate 431 to thereby promote the defrosting operation of first evaporator 411, while the circulation and cooling of the air in the second air circulating passage continues via outer passage 321*b*. Conversely, if frost develops on the second evaporator 412, instead of the first evaporator 411, shutter plate 431 is driven to intercept the air flow through outer passage 321*b* by the operation of motor 47 (this position is indicated by C in FIG. 1) while the circulation and cooling of the air in the first air circulating passage continues via inner passage 321*a*. When shutter plate 431 closes the discharge opening of outer passage 321*b*, the defrosting operation of the second evaporator 412 is started. The position of shutter plate 431 in any situation is determined by the relationship of the depressions on cam plate 45.

Additionally, if during the operation of the refrigerated display case support shaft 432 or shutter plate 431 become frozen, the rotating motion of supporting shaft 432 is obstructed and it becomes increasingly difficult to rotate the supporting shaft 432. Since the motor 47 is placed on the movable plate 48, the belt 52 may be easily removed from the pair of pulleys 511 and 512, thereby preventing damage to the motor and shutter mechanism. Also, since most of the motor box 44 is disposed in the second air circulating passage, overcooling of the motor 47 due to the cooler air in the first air circulating passage is prevented.

Figure 7:
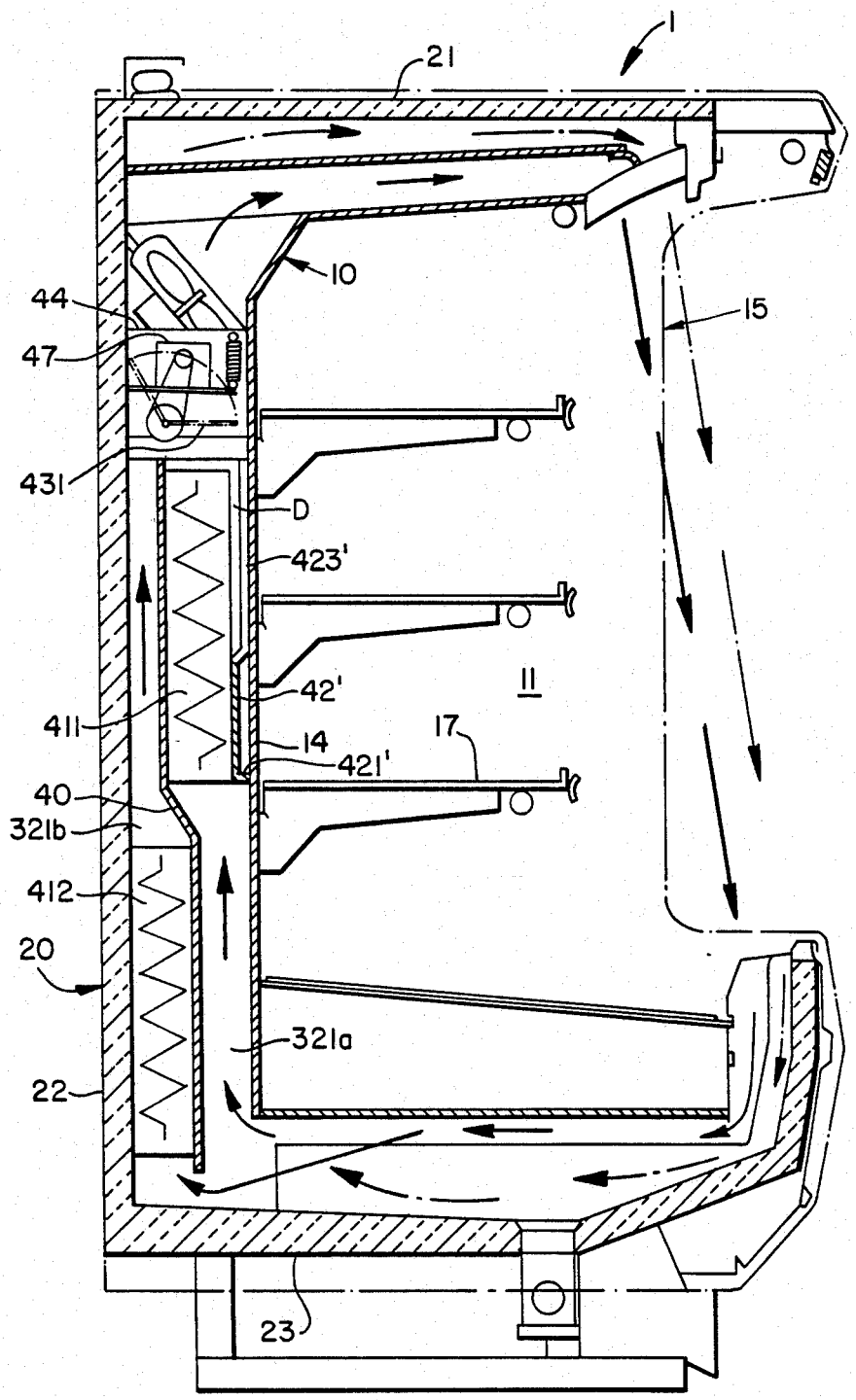
FIG. 7 is a sectional view of a refrigerated display case in accordance with another embodiment of this invention.
Figure 8:
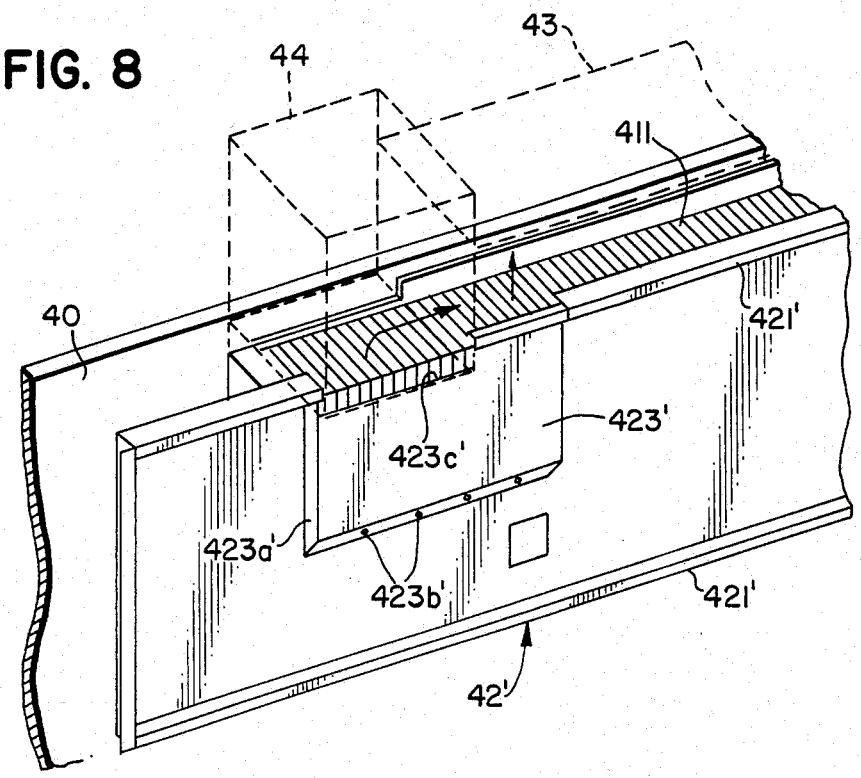
FIG. 8 is an enlarged perspective view of a refrigerated air passage used in the refrigerated display case of FIG. 7.
Figure 9:
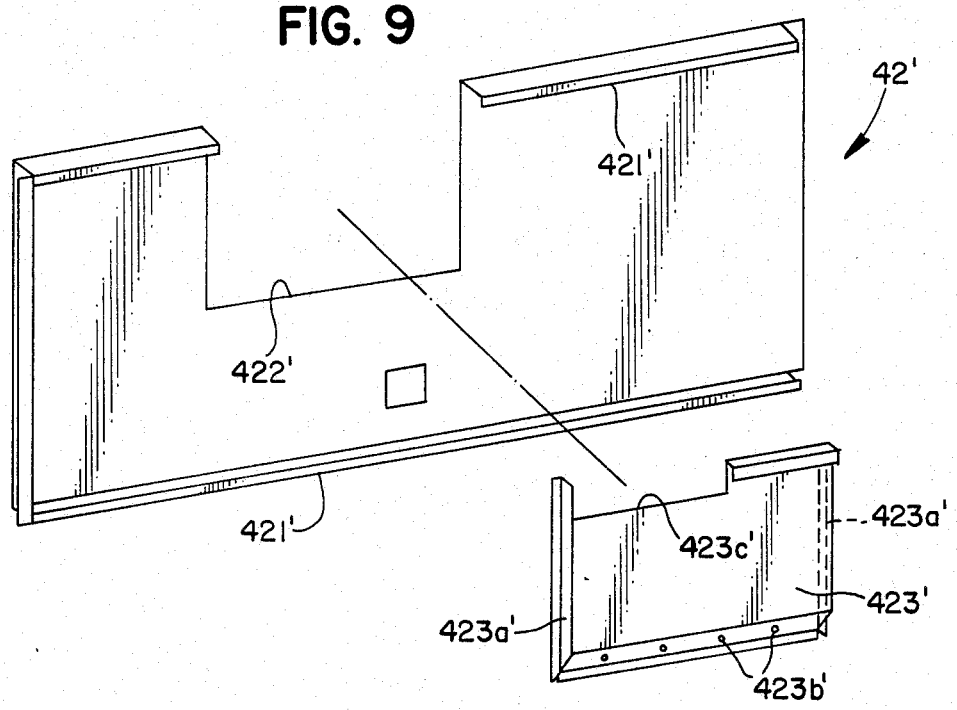
FIG. 9 is a perspective view of an attached plate utilized in FIG. 8.

FIGS. 7–9 show another embodiment of the refrigerated display case according to this invention in which the attached plate for the first evaporator is modified from that previously described (similar parts are represented by the same reference numbers as in the embodiment shown in FIGS. 1–3). Attached plate 42 is normally placed on one side surface of first evaporator 411 to cover the whole side surface to prevent the leakage of air flow passed through first evaporator 411 from the side surface. Instead, in this embodiment, attached plate 42 is fastened on the rear panel 14 of interior cabinet 10 through flange portion 421' extended from the upper and lower end portion thereof. Furthermore, the portion of attached plate 42', which is across from the motor box 44 has a cut-out portion 422' and a separate cover plate 423' which is attached on plate 42' to cover cut-out portion 422' at a distance D from the end surface of first evaporator 411.

Separate cover plate 423' is fastened on attached plate 42' through flange portions 423*a'* which extend from both sides and the bottom of cover plate 423' to space at a distance D the plane of attached plate 42' from cover plate 423'. A plurality of holes 423*b'* are formed in the bottom flange portion 423*a'* to let any condensing water escape. A cut-out portion 423*c'* may be formed on the upper edge of separate cover plate 423' to accept the motor box 44. Therefore, the air blocked by motor box 44 passes the first evaporator 411 through the space within distance D of the attached plate 423', allowing heat exchange with the first evaporator 411 in that area.

This is important since, if the motor box 44 is disposed on the upper surface of the first evaporator 411, the air flow through the first evaporator 411 is partially blocked by the motor box 44. Thus, the efficiency of the first evaporator 411 is reduced due to a partial blockage of the air flow. Also, efficiency between the first and second evaporators 411, 412 may be unequal. However, these difficulties are resolved by the above-mentioned construction.

FIGS. 10–13 show still another embodiment of the refrigerated display case according to this invention, in which the damper mechanism disposed in the discharge opening of the first and second passages is modified from that previously described in FIGS. 1–3 (similar parts are represented by the same reference numbers as the embodiment shown in FIGS. 1–3). The damper box 43' comprises a rectangularly-shaped case 431' which has upper and bottom openings 431*a'* and 431*b'* and cylindrical drum element 432'. Cylindrical drum element 432' horizontally extends within case 431' and is rotatably supported on case 431' through support shaft 433'. As clearly shown in FIGS. 11 and 12, cylindrical drum element 432' has two openings 432*a'* at its peripheral surface to form an air flow passage, i.e., outer periphery of cylindrical drum element 432' is divided by two arc-shaped plates 432*b'* which are placed to oppose one another to form the opening portions 432*a'*. Case 431' is also provided with partition plates 60 at its center portion and on each side to form upper opening 431*a'* and bottom opening 431*b'*. The inner end surface of each partition plate 60 is located in close contact with the outer surface of each arc-shaped plate 432*b'* of cylindrical drum element 432 to secure sealing between the cylindrical drum element 432' and the partition plate 60. Thus, air leakage through the gap between the cylindrical drum element 432' and the partition plates 60 is prevented. Furthermore, the partition plate 60 in bottom opening 431*b'* is placed adjacent to a partition plate 40, thus, bottom opening 431*b'* is divided into two suction spaces 61*a*, 61*b* each of which is connected with first and second passage 321*a*, 321*b*, respectively.

Figure 13:
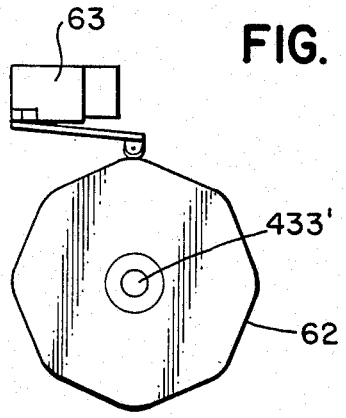
FIG. 13 is a side view of the damper mechanism for illustrating rotational control of the damper mechanism.

The rotating amount of cylindrical drum element 432' per one cycle of motor operation is easily determined by a polygonal shaped cam 62 and microswitch 63. As shown in FIG. 13, a polygonally-shaped cam 62 is fixed on one end portion of support shaft 433' and microswitch 63 is placed adjacent to the outer peripheral portion of cam 62. The switch is activated by the passage of each corner of the polygonal cam.

Figure 14A:
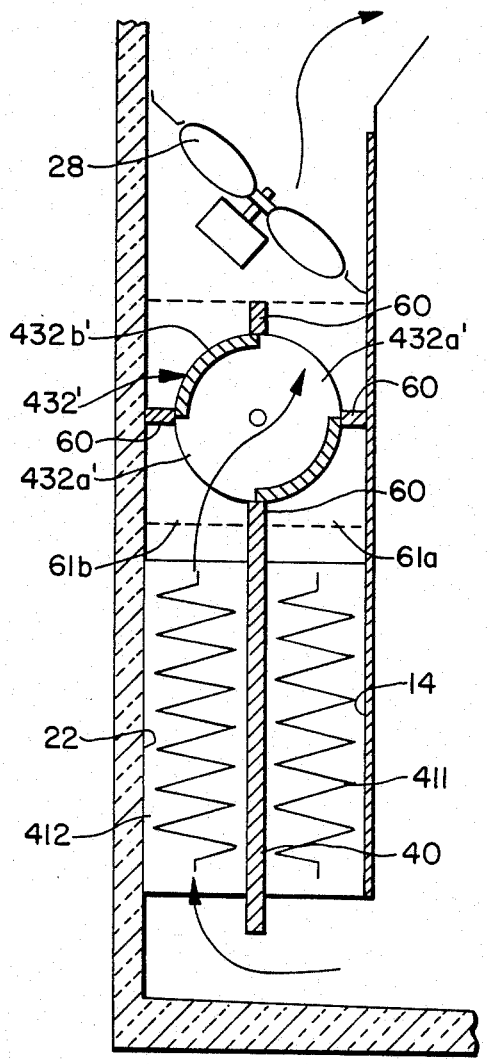
Figure 14B:
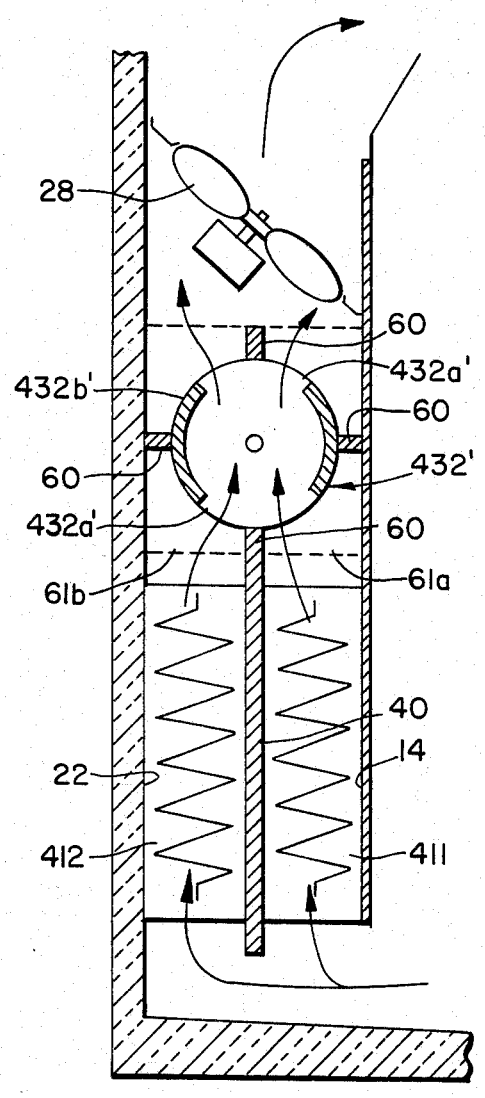
Figure 14C:
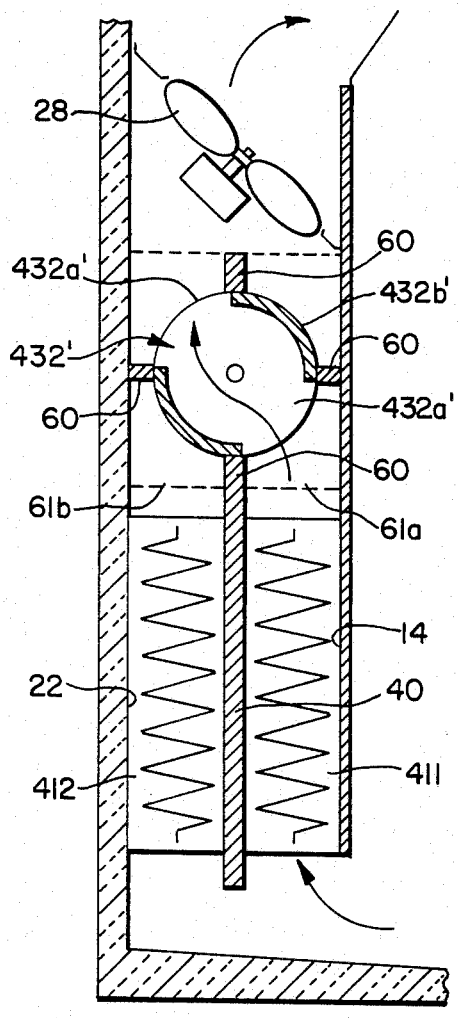

Referring to FIGS. 14*a*–14*c*, the operation of the cylindrical drum element will be explained. In the figures, cylindrical drum element 432' is rotated in a counter-clockwise direction by 45° in each operation, as shown in the figures. The air flow direction is indicated by the solid arrows in each figure.

Figure 14D:
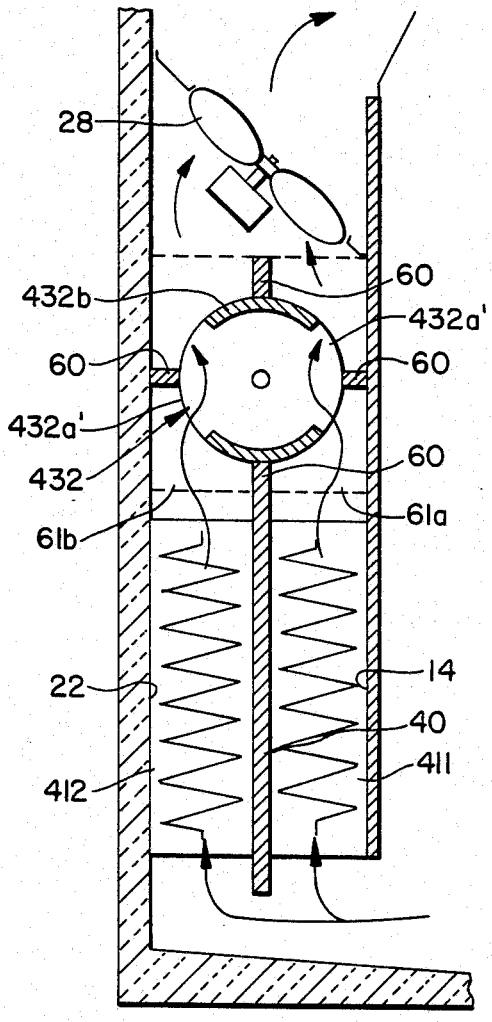

In the normal operation of the refrigerating unit, cylindrical drum element 432' is normally positioned to enable the air to flow through first and second passages 321*a*, 321*b* (this position is shown in FIGS. 14*b* and 14*d*), i.e., the opening 432*a'* of the cylindrical drum element 432' is positioned to ensure the air flow passage from the two suction spaces 61*a*, 61*b*. On the other hand, if frost occurs on either one of the evaporators, cylindrical drum element 432' is rotated to block the air flow through the evaporator on which the frost develops, i.e., in FIG. 14*a*, if first evaporator 411 should need to be defrosted, the arc-shaped plate 432*b'* of cylindrical drum element 432' blocks the air flow through the inner passage 321*a*. If the second evaporator 421 should need to be defrosted, the air flow through the outer passage 321*b* is blocked by the arc-shaped plate 432*b'* of the cylindrical drum element 432', as shown in FIG. 14*c*.

As mentioned above, in this invention, some parts of the refrigerated air circulating conduit are divided into two chambers in which the evaporator is placed and opening and closing of the discharge opening of each chamber is selectively controlled by the damper mechanism. Therefore, if either one of the evaporators is defrosted while the refrigerated air circulation is in operation, the predetermined temperature in display space 11 is maintained.

This invention has been described in detail in connection with the preferred embodiments. These embodiments, however, are merely illustrative and the present invention is not restricted thereto. It will be easily understood by those skilled in the art that other variations and modifications can be easily made, particularly in matters of size, shape and arrangement of parts, within the scope of this invention, as defined by the broad general meaning of the terms in which the appended claims are expressed.

What is claimed is:

1. In a refrigerated display case having an interior cabinet and an exterior member, including a refrigerating means, a circulating means for forcing air into contact with said refrigerating means, and a passage means for directing the refrigerated air, said case defining a front opening for access to the interior thereof, at least two air inlets and corresponding outlets extending across opposed edges of said front opening, said passage means including at least inner and outer conduits communicating with the respective outlets and inlets and defining between said interior cabinet and said exterior member, said circulating means operating to drive separate air streams through said passage means and across said front opening in an innermost stream and an outermost stream, and said refrigerating means being located in said inner conduit for refrigerating the innermost stream crossing said access opening, the improvement comprising:

a portion of said inner conduit being divided into two chambers;

an evaporator of said refrigerating means being located within each chamber; and a damper device extending across the discharge openings of said two chambers for selectively controlling the opening and closing of the discharge openings, said damper device being operated by a driving device, and said damper device comprising a rectangular cross-sectional shaped case having upper and bottom openings and a shutter plate rotatably supported in said case through a support shaft, said shutter plate being selectively located to block a discharge opening from one of the chambers to prevent air circulation therethrough while allowing air circulation through the other chamber.

2. The refrigerated display case of claim 1 wherein one end portion of said support shaft of said damper device extends into said driving device and is rotatably supported by said driving device, and said driving device comprises an outer case, a motor, a drive shaft extending from said motor, connecting means including a belt and pulley for transmitting the rotating motion from the drive shaft of said motor to said support shaft, and a cam rotor to control the rotation range of said support shaft.

3. The refrigerated display case of claim 2 wherein said motor of said driving device is placed on a support plate, said support plate being hinged to said outer case and pulled by a spring member to form a space between said drive draft and said support shaft.

4. In a refrigerated display case having an interior cabinet and an exterior member, including a refrigerating means, a circulating means for forcing air into contact with said refrigerating means, and a passage means for directing the refrigerated air, said case defining a front opening for access to the interior thereof, at least two air inlets and corresponding outlets extending across opposed edges of said front opening, said passage means including at least inner and outer conduits communicating with the respective outlets and inlets and defining between said interior cabinet and said exterior member, said circulating means operating to drive separate air streams through said passage means and across said front opening in an innermost stream and an outermost stream, and said refrigerating means being located in said inner conduit for refrigerating the innermost stream crossing said access opening, the improvement comprising:

a portion of said inner conduit being divided into chambers; an evaporator of said refrigerating means being located within each chamber; and a damper device extending across the discharge openings of said two chambers for selectively controlling the opening and closing of the discharge openings, said damper device being operated by a driving device, and said damper device comprising a rectangularly shaped outer case having opposing side plates, an upper opening and a bottom opening and a cylindrical drum element rotatably supported in said outer case, said cylindrical drum element being provided with an opposed opening at outer peripheral portions thereof for forming a refrigerated air circulation path through said drum.

5. The refrigerated display case of claim 4 wherein said outer case of said damper device is provided with a partition projections at a center portion of the side plates and at a center portion of said upper and bottom openings, each of said projections being in close contact with the outer surface of said cylindrical drum element.

6. The refrigerated display case of claim 4 wherein the rotating motion of said support shaft is controlled by a polygonal-shaped cam plate fixed on said support shaft and a microswitch disposed adjacent to said cam plate.

7. The refrigerated display case of claim 1 wherein said inner conduit comprises a first top space which is formed in the top portion of said case for communicating with one of said outlets, a first bottom space which is formed in the bottom portion of said case for communicating with one of said inlets, and a first rear space upwardly extending for communication between said upper and bottom spaces, and said two chambers being located in said rear space.

8. The refrigerated display case of claim 9 wherein said two chambers are partitioned by a separator plate and an evaporator of said refrigerating means is disposed in each of said chambers, a first of said evaporators being located at one end portion of a first of said chambers and the other of said evaporators being located at the opposite end portion of a second of said chambers and out of alignment with said first evaporator.

9. The refrigerated display case of claim 8 wherein one of said evaporators is disposed in an inner chamber of said two chambers and is placed on an upper end thereof and covers the one side surface by an attachment plate, which is fastened on said interior cabinet, to prevent the generation of unrefrigerated air flow.

10. The refrigerated display case of claim 9 wherein said attachment plate is provided with a cut-out portion disposed opposite a driving device of said damper device, said cut-out portion being covered by a cover plate to form a gap with said evaporator.

11. The refrigerated display case of claim 1 wherein said driving device partially extends into said outer conduit to prevent the over cooling thereof.

* * * * *

UNITED STATES PATENT AND TRADEMARK OFFICE

CERTIFICATE OF CORRECTION

PATENT NO. : 4,633,677

DATED : January 6, 1987

INVENTOR(S) : Kazuo Maehara

It is certified that error appears in the above-identified patent and that said Letters Patent is hereby corrected as shown below:

Column 4, line 54, "refrigerated" should be —unrefrigerated—.

Claim 8, Column 9, line 13, "9" should be —7—.

Signed and Sealed this

Twenty-eighth Day of April, 1987

*Attest:*

DONALD J. QUIGG

*Attesting Officer*

*Commissioner of Patents and Trademarks*